US009179812B2

(12) United States Patent
Bruders et al.

(10) Patent No.: US 9,179,812 B2
(45) Date of Patent: Nov. 10, 2015

(54) HARD SURFACE CLEANERS HAVING CLEANING HEADS WITH ROTATIONAL ASSIST, AND ASSOCIATED SYSTEMS, APPARATUSES AND METHODS

(71) Applicant: Sapphire Scientific Inc., Prescott, AZ (US)

(72) Inventors: William Bruders, Sedro Woolley, WA (US); Brett Bartholmey, Bellingham, WA (US); Bill Elmer Richardson, Prescott Valley, AZ (US); Sean Aldrich, Bellingham, WA (US); Keith Studebaker, Tumwater, WA (US); Roy Studebaker, Centralia, WA (US)

(73) Assignee: Sapphire Scientific Inc., Prescott, AZ (US)

( * ) Notice: Subject to any disclaimer, the term of this patent is extended or adjusted under 35 U.S.C. 154(b) by 8 days.

(21) Appl. No.: 13/844,029

(22) Filed: Mar. 15, 2013

(65) Prior Publication Data

US 2014/0137895 A1 May 22, 2014

Related U.S. Application Data

(60) Provisional application No. 61/728,205, filed on Nov. 19, 2012.

(51) Int. Cl.
*A47L 11/00* (2006.01)
*A47L 11/40* (2006.01)
(Continued)

(52) U.S. Cl.
CPC ..... *A47L 11/4044* (2013.01); *A47L 11/4069* (2013.01); *A47L 11/4088* (2013.01);
(Continued)

(58) Field of Classification Search
CPC ..... A47L 11/4044; A47L 11/4088; A47L 11/4069; E01H 1/103; B08B 3/024
USPC ..... 15/320, 322
IPC ..... A47L 11/00
See application file for complete search history.

(56) References Cited

U.S. PATENT DOCUMENTS 1,211,948 A 1/1917 Koster
1,498,255 A 6/1924 Carter
(Continued)

FOREIGN PATENT DOCUMENTS

JP 2002311192 A 10/2002
WO WO-0106188 A1 1/2001
WO WO-2005118959 A1 12/2005

OTHER PUBLICATIONS

"TMF Review: Flash Xtractor by Waterclaw," ; http://www.youtube.com/watch?v=ts0xmTmBFsY, ; uploaded Jul. 2, 2010, 1 page.
(Continued)

*Primary Examiner* — David Redding
(74) *Attorney, Agent, or Firm* — Perkins Coie LLP

(57) ABSTRACT

A hard surface cleaner having a cleaning head with rotational assist. In one embodiment, the cleaning head includes a housing having a fluid-supply and vacuum inlets. The housing also includes at least one flow-control inlet arranged with the vacuum inlet to draw a flow of air into the housing through the flow-control inlet. The cleaning head further includes a spray assembly at least partially enclosed within the housing. The spray assembly includes a shaft, at least one spray nozzle operably coupled to the shaft, and a plurality of fins also operably coupled to the shaft. The spray nozzle is configured to receive a pressurized fluid from the fluid-supply inlet and to rotate about the shaft by delivering the pressurized fluid toward a floor surface. The fins are positioned at least partially within the flow of air through the flow control inlet to control the rotational speed of the spray assembly.

19 Claims, 10 Drawing Sheets

(51) Int. Cl.

| | |
|---|---|
| ***B05B 3/04*** | (2006.01) |
| ***B05B 3/10*** | (2006.01) |
| ***B08B 3/02*** | (2006.01) |
| ***E01H 1/10*** | (2006.01) |

(52) U.S. Cl.
CPC ..... *B05B3/0409* (2013.01); *B05B 3/1035* (2013.01); *B08B 3/024* (2013.01); *E01H 1/103* (2013.01); *B08B 2203/0229* (2013.01)

(56) References Cited

U.S. PATENT DOCUMENTS

| | | | |
|---|---|---|---|
| 2,000,930 | A | 5/1935 | De Nagy Bela |
| 2,063,253 | A | 12/1936 | Kuhnel |
| 2,624,063 | A | 1/1953 | Van Der Heem |
| 2,744,272 | A | 5/1956 | Theis |
| 2,764,394 | A | 9/1956 | Miller |
| 2,904,817 | A | 9/1959 | Brennan |
| 3,243,832 | A | 4/1966 | Allen |
| 3,619,848 | A | 11/1971 | Salzmann |
| 3,840,935 | A | 10/1974 | Fitzgerald, Jr. et al. |
| 3,849,823 | A | 11/1974 | Adamson et al. |
| 3,864,784 | A | 2/1975 | Kilstrom et al. |
| 3,940,826 | A | 3/1976 | Phillips et al. |
| 4,037,290 | A | 7/1977 | Rose et al. |
| 4,182,001 | A | 1/1980 | Krause |
| 4,377,018 | A | 3/1983 | Cain |
| 4,441,229 | A | 4/1984 | Monson |
| 4,464,810 | A | 8/1984 | Karpanty |
| 4,542,556 | A | 9/1985 | Hepple |
| 4,544,702 | A | 10/1985 | DeVera |
| 4,571,849 | A | 2/1986 | Gardner et al. |
| 4,692,959 | A | 9/1987 | Monson |
| 4,731,956 | A | 3/1988 | Wood |
| D295,092 | S | 4/1988 | Mizuno et al. |
| 4,862,551 | A | 9/1989 | Martinez et al. |
| D306,788 | S | 3/1990 | McAllister et al. |
| 4,989,294 | A | 2/1991 | Fischer |
| 5,048,148 | A | 9/1991 | Gleadall |
| 5,237,719 | A | 8/1993 | Dwyer, Jr. et al. |
| D345,234 | S | 3/1994 | Iorli |
| 5,312,044 | A | 5/1994 | Eaton |
| 5,392,492 | A | 2/1995 | Fassauer |
| D381,144 | S | 7/1997 | Moine et al. |
| 5,706,549 | A | 1/1998 | Legatt et al. |
| 5,778,646 | A | 7/1998 | Pfisterer |
| 5,867,864 | A | 2/1999 | Miller et al. |
| 5,970,574 | A | 10/1999 | Thrash, Jr. |
| 6,013,227 | A | 1/2000 | Lin et al. |
| 6,052,861 | A | 4/2000 | Keller |
| D424,766 | S | 5/2000 | Martin |
| 6,151,748 | A | 11/2000 | Earhart, Jr. et al. |
| 6,151,784 | A | 11/2000 | Maruyama |
| 6,243,914 | B1 | 6/2001 | Studebaker |
| 6,370,728 | B1 | 4/2002 | Burns |
| 6,413,323 | B2 | 7/2002 | Shook et al. |
| 6,421,875 | B1 | 7/2002 | Coombs et al. |
| D468,499 | S | 1/2003 | Kitts |
| D479,636 | S | 9/2003 | Kitts |
| D518,259 | S | 3/2006 | Wertz |
| D520,202 | S | 5/2006 | Dyson et al. |
| D522,197 | S | 5/2006 | Dyson et al. |
| 7,159,271 | B2 | 1/2007 | Sepke et al. |
| D538,986 | S | 3/2007 | Ingram |
| D565,262 | S | 3/2008 | Dyson et al. |
| 7,392,566 | B2 | 7/2008 | Gordon et al. |
| 7,624,474 | B1 | 12/2009 | Cho |
| D635,315 | S | 3/2011 | Wertz |
| 7,962,995 | B2 | 6/2011 | Allaway |
| D643,169 | S | 8/2011 | Calvert |
| D663,909 | S | 7/2012 | Andreesen |
| 8,453,293 | B1 | 6/2013 | Monson |
| 8,510,902 | B2 * | 8/2013 | Kappos ..... 15/320 |
| 2002/0178529 | A1 * | 12/2002 | Geyer et al. ..... 15/320 |
| 2005/0144751 | A1 | 7/2005 | Kegg et al. |
| 2006/0196074 | A1 | 9/2006 | Vilhunen |
| 2007/0079472 | A1 | 4/2007 | Carter et al. |
| 2007/0113368 | A1 | 5/2007 | Alexander |
| 2007/0226943 | A1 | 10/2007 | Lenkiewicz et al. |
| 2008/0094784 | A1 | 4/2008 | Adunka et al. |
| 2009/0038105 | A1 | 2/2009 | Mayer |
| 2009/0139046 | A1 | 6/2009 | Kappos |
| 2012/0151708 | A1 | 6/2012 | Carter et al. |
| 2012/0233804 | A1 | 9/2012 | Studebaker et al. |

OTHER PUBLICATIONS

International Search Report and Written Opinion for International Patent Application No. PCT/US2013/070618, Applicant: Sapphire Scientific, Inc., mailed Mar. 31, 2014.

U.S. Appl. No. 13/843,618, filed Mar. 15, 2013, Bruders.

Internet Publication "Positive vs. Negative Angles," ; http://www4.nau.edu/ifwd/ts_lessons/angle/angle_upload/A_posneg.htm, 1 page, 2003.

* cited by examiner

126
$(V_3>V_2>V_1)$
110
125

110
126
$V_2(V_2>V_1)$
125
4A
4A

123
$V_2(V_2>V_1)$
118
229a
456a
456b
243
228
235
242
232
123
126
454
AIR
125
229a
130
242
FLOOR

HARD SURFACE CLEANERS HAVING CLEANING HEADS WITH ROTATIONAL ASSIST, AND ASSOCIATED SYSTEMS, APPARATUSES AND METHODS

CROSS-REFERENCE TO RELATED APPLICATION

The present application claims priority to U.S. Provisional Application No. 61/728,205, filed Nov. 19, 2012, which is incorporated herein by reference in its entirety.

TECHNICAL FIELD

The present disclosure is directed generally to hard surface cleaners, and in particular hard surface cleaners that deliver pressurized fluids.

BACKGROUND

Conventional devices have been developed to clean hard surfaces using a cleaning head with a rotating spray bar that directs pressurized water toward the target surface. One drawback with such devices is that high pressures can damage delicate surfaces. Lowering the pressure, however, decreases the rotational speed of the spray bar, making these devices unsuitable for these applications.

Another drawback with such devices is that they typically include a truck-mounted or large portable water pressurization system and/or a truck-mounted or large portable wastewater collection system. Accordingly, such systems are cumbersome and/or too complicated for the typical homeowner. As a result, there exists a need for simplified high pressure systems suitable for cleaning hard surface, including tiled and/or grouted surfaces.

BRIEF DESCRIPTION OF THE DRAWINGS

FIGS. 1A and 1B are an isometric illustration (FIG. 1A) and a rearview illustration (FIG. 1B) of a high pressure system including a surface cleaner with a cleaning head configured in accordance with an embodiment of the present technology.

DETAILED DESCRIPTION

The present disclosure is directed generally to systems and methods for cleaning hard surfaces, including concrete, decking, tiles and/or grout. Specific details of several embodiments of the disclosed technology are described below with reference to particular configurations. In other embodiments, aspects of the disclosed technology can include other arrangements. Several details describing structures or processes that are well-known and often associated with these types of systems but that may unnecessarily obscure some significant aspects of the presently disclosed technology are not set forth in the following description for purposes of clarity. Although the following disclosure sets forth several embodiments of different aspects of the disclosed technology, several other embodiments can have different configurations and/or different components than those described in this section. Accordingly, the disclosed technology may include other embodiments with additional elements not described below with reference to FIGS. 1-7B, and/or without several of the elements described below with references to FIGS. 1-7B.

Figure 1B:
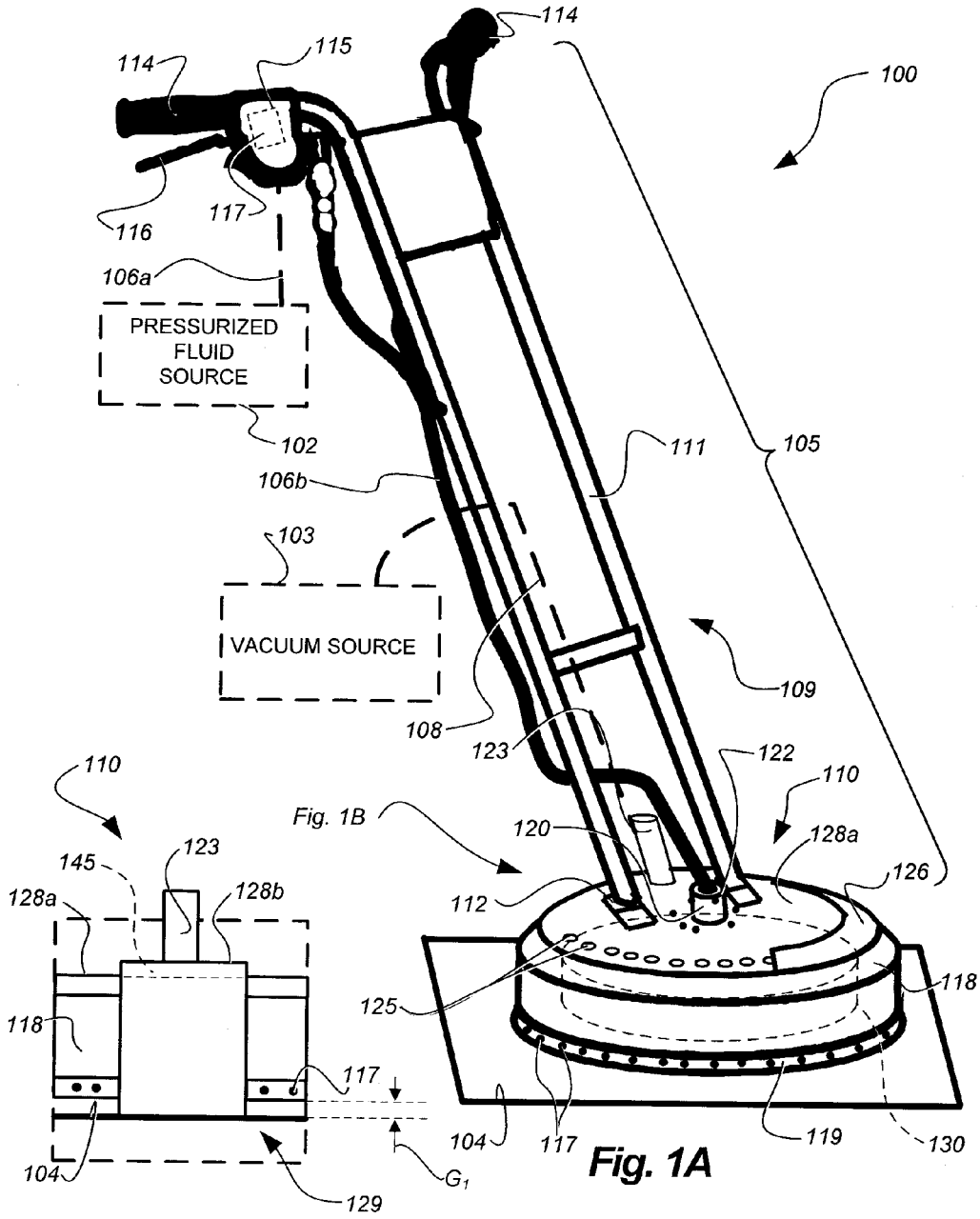

FIGS. 1A and 1B are an isometric view illustration (FIG. 1A) and a rear view illustration (FIG. 1B) of a hard-surface cleaning system 100 suitable for cleaning hard surfaces, including, for example, concrete, decking, tiles and/or grout. Referring first to FIG. 1A, the system 100 includes a pressurized fluid source 102 (shown schematically), a vacuum source 103 (also shown schematically), and a surface cleaner 105. In the illustrated embodiment, the fluid source 102 is coupled to a first fluid supply line 106*a* (e.g., a hose) and the vacuum source 103 is coupled to a vacuum supply line 108 (e.g., a flexible pipe). In some embodiments, the fluid and vacuum sources 102, 103 are remote sources, including remotely-located (e.g., portable, truck-mounted, etc.), pump-based sources.

The surface cleaner 105 includes a transport assembly 109 operably coupled to a cleaning head 110. The transport assembly 109 includes a columnar frame 111 and hinges 112 pivotally coupling the cleaning head 110 to the columnar frame 111. The columnar frame 111 further includes handle grips 114 and a fluid-flow controller 115 positioned proximal to one of the individual handle grips 114. The fluid-flow controller 115 includes a valve 117 (e.g., an "on/off" valve; shown schematically) and a lever 116. The valve 117 has an input coupled to the first fluid supply line 106*a* and an output coupled to a second fluid supply line 106*b* between the fluid-flow control 115 and the cleaning head 110.

The cleaning head 110 includes a housing 118, a rim 119 at a base of the housing 118, and a rotary union 120 operably coupled to a rotatable spray assembly 130 (e.g., a rotor assembly; shown schematically) within the housing 118. The cleaning head 110 further includes a fluid-supply inlet 122 coupled to the second fluid supply line 106*b*, a vacuum inlet 123 coupled to the vacuum supply line 108, and a number of flow-control inlets 125 (e.g., openings) that are open to the ambient air and adjustably covered by a louver 126. The louver 126 can be attached to a first top wall 128*a* of the housing 110 with tabs, grooves, or other suitable features (not shown) that allow the louver 126 to slide across the flow-control inlets 125 to adjustably cover/uncover the inlets 125.

In operation, an operator uses the transport assembly 109 to hold the cleaning head 110 so that it is generally parallel with a floor surface 104, while moving the cleaning head 110 across the floor surface 104. The hinges 112 allow the operator to change the angle of the columnar frame 111 (relative to the floor surface 104) but still maintain parallel alignments. For example, the operator can change the angle of the columnar frame 111 to raise or lower the handle grips 114 (e.g., to accommodate the operator's height. As the operator moves the cleaning head 110 across the floor surface 104, the rim 119 reduces friction between the housing 118 and the floor surface 104. In one embodiment, the rim 119 can include a nonabrasive material such as polyethylene, which can pass over smooth surfaces without causing damage. In another embodiment, the rim 119 can include a "brush cup," such as a ring of bristles or coarse materials suitable for non-smooth surfaces, including asphalt, unfinished concrete, etc.

The operator can operate the lever 116 to open the valve 117 to deliver the pressurized fluid to the spray assembly 130 via the second fluid supply line 106*b*. In some embodiments, the pressurized fluid can include water and/or chemicals, such as those containing suitable acidic and/or alkaline elements. In one embodiment, suitable chemicals are available from Sapphire Scientific of Prescott, Ariz.

Upon receiving the pressurized fluid, the spray assembly 130 sprays the pressurized fluid toward a portion of the floor surface 104 at least partially enclosed by the housing 118. The fluid spray imparts a mechanical cleaning action for dislodging debris and contaminates from the floor surface 104. The spray assembly 130 also rotates to distribute the spray across the portion of the floor surface. As described in greater detail below, the user can adjust the rotational velocity of the spray by adjusting the louver 126 (i.e., by covering/uncovering a portion of the flow-control inlets 125 with the louver 126). In one embodiment, the pressured fluid has an operating pressure in the range of about 700-2500 psi. In another embodiment, the rotational speed is in the range of about 1500-3000 rpm.

While the spray is delivered to the floor surface 104, the vacuum inlet 123 collects spent fluid (e.g., non-pressurized fluid containing debris and contaminants) which is then drawn by the vacuum source 103. The rim 119 can form a seal that at least partially contains the spent fluid within an enclosure defined by the housing. In some embodiments, the rim 119 can include apertures 117 that allow air to enter the cleaning head 110 as the vacuum is drawn on the cleaning head 110. Accordingly, the apertures 117 can prevent the cleaning head 110 from clamping down (e.g., "sucking down") onto the hard surface under the force of the vacuum.

As best seen in FIG. 1B, the housing 118 can include a "bump-out" region 129 toward a rear portion of the cleaning head 110 that slightly raises the rear portion of the head above the floor surface 104 by a gap $G_1$. Similar to the apertures 117, the bump-out region 129 allows ambient air to enter the cleaning head 110 to prevent the cleaning head 110 from clamping down. The bump-out region 129 also defines a vacuum cavity 145 (drawn in broken lines) within an enclosure of the cleaning head 110 and between the first top wall 128*a* and a second top wall 128*b* of the housing 118. The vacuum cavity is connected to the vacuum inlet 123 to draw a vacuum on the interior region of the cleaning head 110.

Figure 2B:
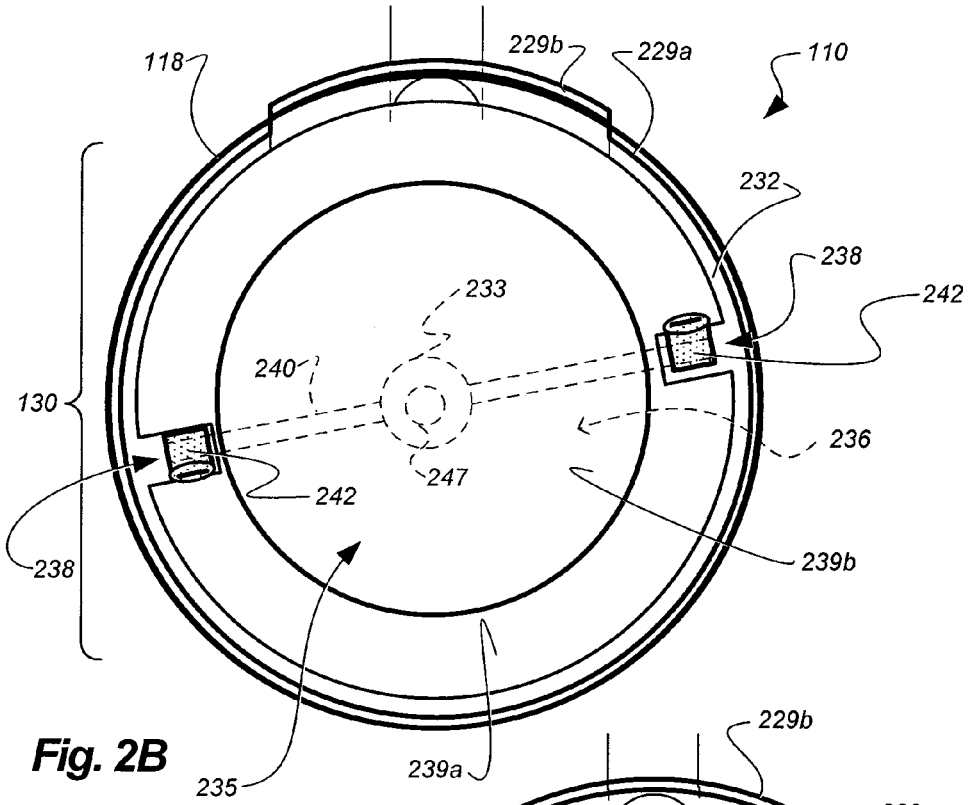
FIGS. 2A and 2B are top view illustrations of the cleaning head of FIG. 1 configured in accordance with an embodiment of the present technology.
Figure 2A:
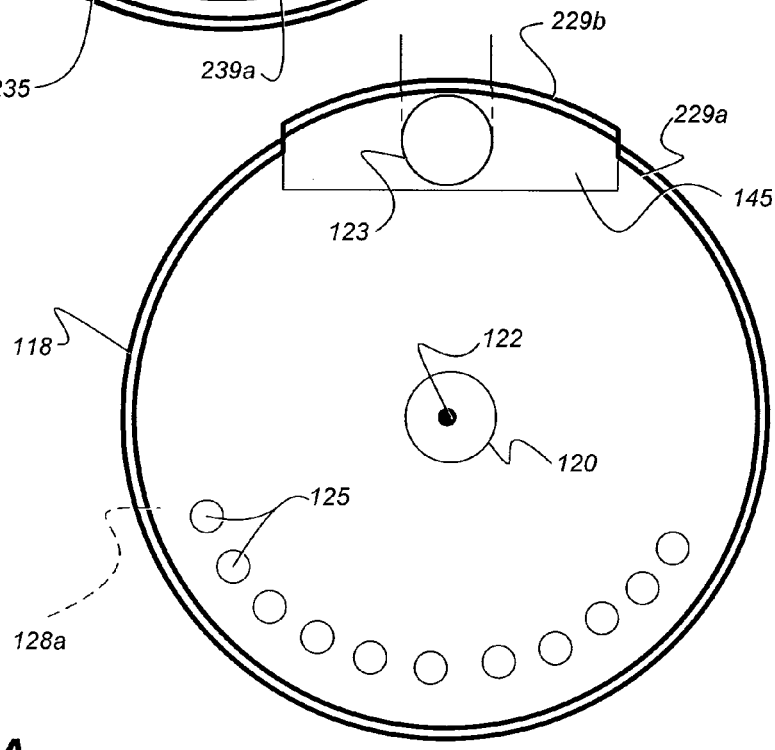

FIGS. 2A and 2B are bottom view illustrations of the cleaning head 110 showing the housing 118 without the spray assembly 130 installed (FIG. 2A) and the housing 118 with the spray assembly 130 installed (FIG. 2B). For purposes of illustration, FIGS. 2A and 2B show the cleaning head 110 without the rim 119. Referring first to the bottom view of FIG. 2A, the housing 118 includes a first sidewall 229*a* at least partially surrounding a circumference of the housing and a second sidewall 229*b* at least partially defining a portion of the vacuum cavity 145. The vacuum cavity 145 at least partially surrounds the vacuum inlet 123. The flow-control inlets 125 extend through the first top wall 128*a* and open the interior of the housing 118 to ambient air.

Referring to the bottom view of FIG. 2B, the spray assembly 130 includes a round plate 232 and a shaft 233 (drawn in broken lines) operably coupled between the plate 232 and the rotary union 120 (FIG. 1). The plate 232 is spaced apart from the first sidewall 229*a* by a gap and includes a first lower side 235, a second upper side 236, and slots 238 extending through the plate 232 at its periphery. At the first lower side 235, the plate 232 includes an inner surface 239*a* and an outer surface 239*b* that is raised upwardly out of the plane of the page. At the second upper side 236, the plate 232 includes a spray bar 240 (drawn in broken lines) completed in fluid communication with two nozzles 242 toward the periphery of the plate 232. The spray bar 240 is attached to the plate 232 and is in fluid communication with the fluid-supply inlet 122 (FIG. 1) via a passageway 247 (drawn in broken lines) through the shaft 233 and the rotary union 120 (FIG. 1). The individual nozzles 242 are connected to opposite ends of the spray bar 240 and extend through one of the slots 238 toward the floor surface 104.

Figure 2C:
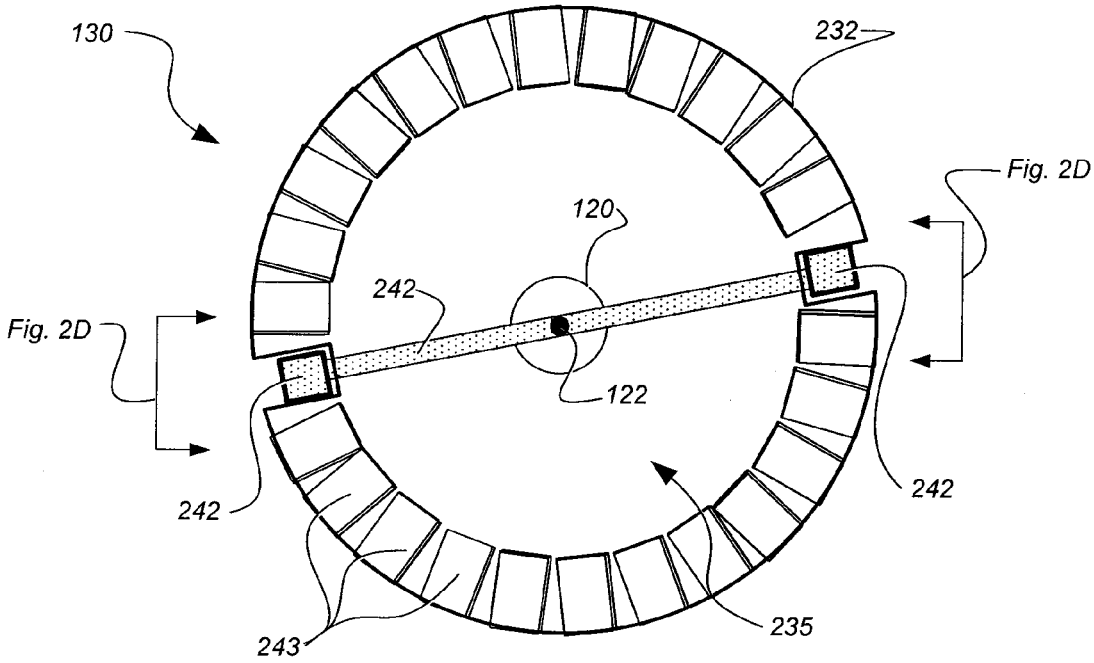
FIGS. 2C and 2D are a top view illustration (FIG. 2C) and an enlarged side view illustration (FIG. 2D) of a rotating spray assembly of the cleaning head of FIG. 1 configured in accordance with an embodiment of the present technology.
Figure 2D:
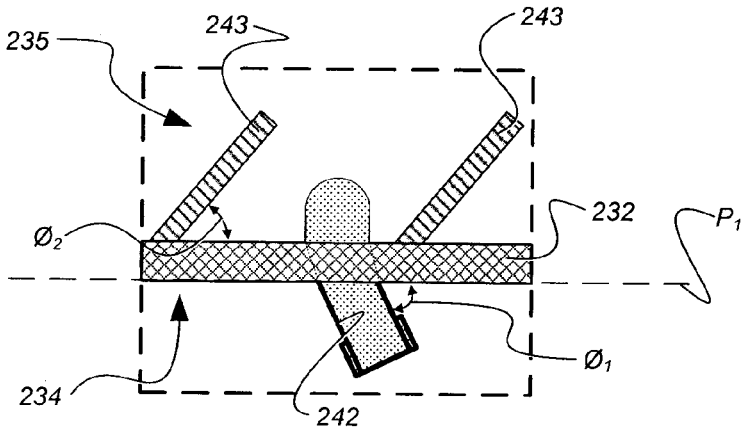

FIG. 2C is a top view illustration of the spray assembly 130 and FIG. 2D is an enlarged side view of a portion at a periphery of the spray assembly 130. Referring to FIGS. 2C and 2D together, the individual nozzles 242 project though the slots at a first angle $\theta_1$ relative to the plane $P_1$ of the plate 232. Because the nozzles 242 are inclined, the spray from the nozzles imparts a rotational velocity to the spray assembly 130. In one embodiment, the first angle $\theta_1$ is in the range of about 70 to 75 degrees. In another embodiment, however, the first angle $\theta_1$ can be larger or smaller. For example, it is expected that a larger first angle $\theta_1$ will achieve more downward fluid-force, and a smaller rotational velocity. Similarly, it is also expected that a smaller first angle $\theta_1$ may achieve less downward fluid-force, and a larger angular velocity. Accordingly, the nozzles 242 can be oriented differently, including angled differently to achieve certain rotational velocities and/or downward fluid force. In addition, in some embodiments, the plate 232 can be configured with different arrangements of nozzles and sprays bars, including additional nozzles and spray bars.

With reference again to FIGS. 2C and 2D, the individual fins 243 project above the plane of $P_1$ of the plate 232 at a second angle $\theta_2$. The second angle $\theta_2$ is configured to appropriately position the fins across a stream of rapidly moving air between the flow-control inlets 125 shown in FIG. 1A and the vacuum cavity 245 also shown in FIG. 1A. As described in greater detail below, it is believed that the rapidly moving air creates lift that can assist the rotation of the spray assembly 130. In one embodiment, the second angle $\theta_2$ is in the range of about 60 to 90 degrees. It is expected, however, that the second angle $\theta_2$ can be outside this range in some embodiments to create a particular amount of lift. Further, the plate 232 can be configured to include more or fewer fins, variously sized fins (e.g., lengths, widths, and thicknesses), differently shaped fins, etc. to achieve an expected amount with suitable lift.

Figures 3A, 3B:
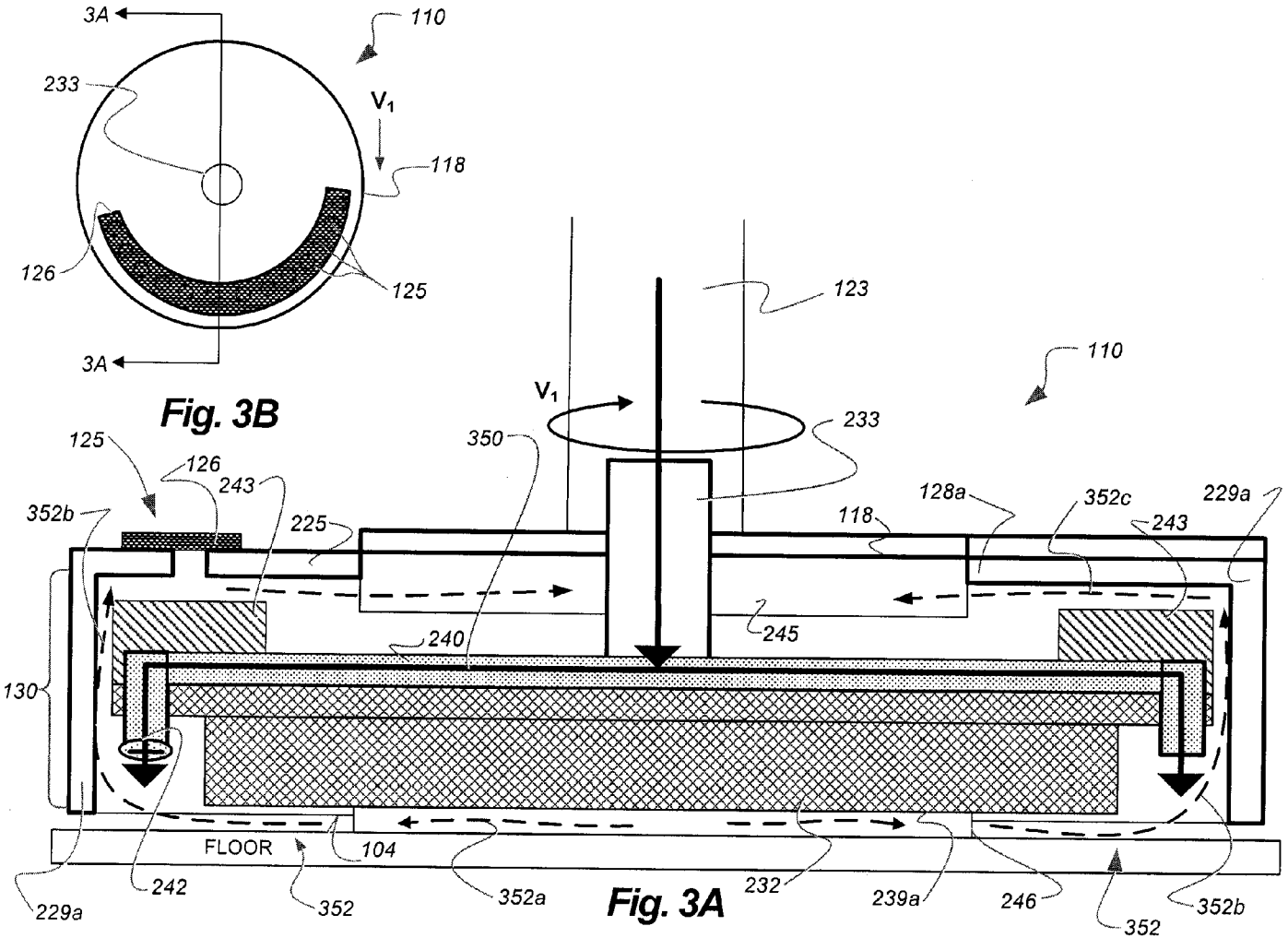
FIGS. 3A and 3B are a side view illustration (FIG. 3A) and a top view illustration (FIG. 3B) of the cleaning head of FIG. 1 in a first operational state in accordance with an embodiment of the present technology.

FIGS. 3A and 3B are, respectively, cross-sectional and top view illustrations of the cleaning head 110 in a first state of operation in which the spray assembly has a first rotational speed $V_1$ about the shaft 233. Referring to FIGS. 3A and 3B together, the louver 126 is movably positioned to completely cover the flow-control inlets 125 to prevent ambient air from entering through the flow-control inlets 125. As discussed above, ambient air can nevertheless enter through apertures 117 in the rim 119 (FIG. 1) and/or through a gap defined by the bump-out region 246 (i.e., to prevent clamp down).

In the first state of operation, the spray nozzles 242 direct a pressurized fluid 350 toward the floor surface 104, which causes the spray assembly 130 to rotate at the first rotational velocity $V_1$. As the cleaning head 110 is moved across the floor surface 104, the spent fluid moves underneath the plate 232. In general, it is believed that the cleaning head 110 removes the spent fluid by a multi-step process that involves a "sling action" in combination with suction at the vacuum cavity 245. In particular, it believed that the sling action causes the spent fluid to move along a fluid flow path 352 (shown as a combination of first through third fluid flow path segments 352*a*-352*c*) that is bounded by portions of the inner surface 239*a* of the plate 232, an inner surface of the first sidewall 229*a*, and an inner surface of the first top wall 128*a*. Once the spent fluid reaches the vacuum cavity 245, the vacuum inlet removes the spent fluid from the enclosure of the housing.

Without being bound to a particular theory, it is believed that rotating the plate 232 in combination with surface tension at the inner surface 239*a* of the plate 232 imparts momentum to the spent fluid. The imparted momentum is believed to cause the spent fluid to move underneath the plate 232 along the first fluid flow path segment 352*a* and toward the first sidewall 229*a*. Accordingly, it is believed that the inner surface 239*a* when proximate to the floor surface 104 can promote surface tension, which in turn may promote the sling action.

It is also believed that the imparted momentum in combination with surface tension at the first sidewall 229*a* causes the spent fluid to move upwardly along the second fluid flow path segment 352*b* toward the first top wall 128*a*. It is further believed that when the spent fluid reaches the inner surface of the first top wall 128*a*, imparted momentum and surface tension move the spent fluid inwardly along the third fluid flow path segment 352*c*) across the top wall. The fluid then moves across the top wall until it is drawn into the vacuum cavity 245.

Figures 4A, 4B, 4C:
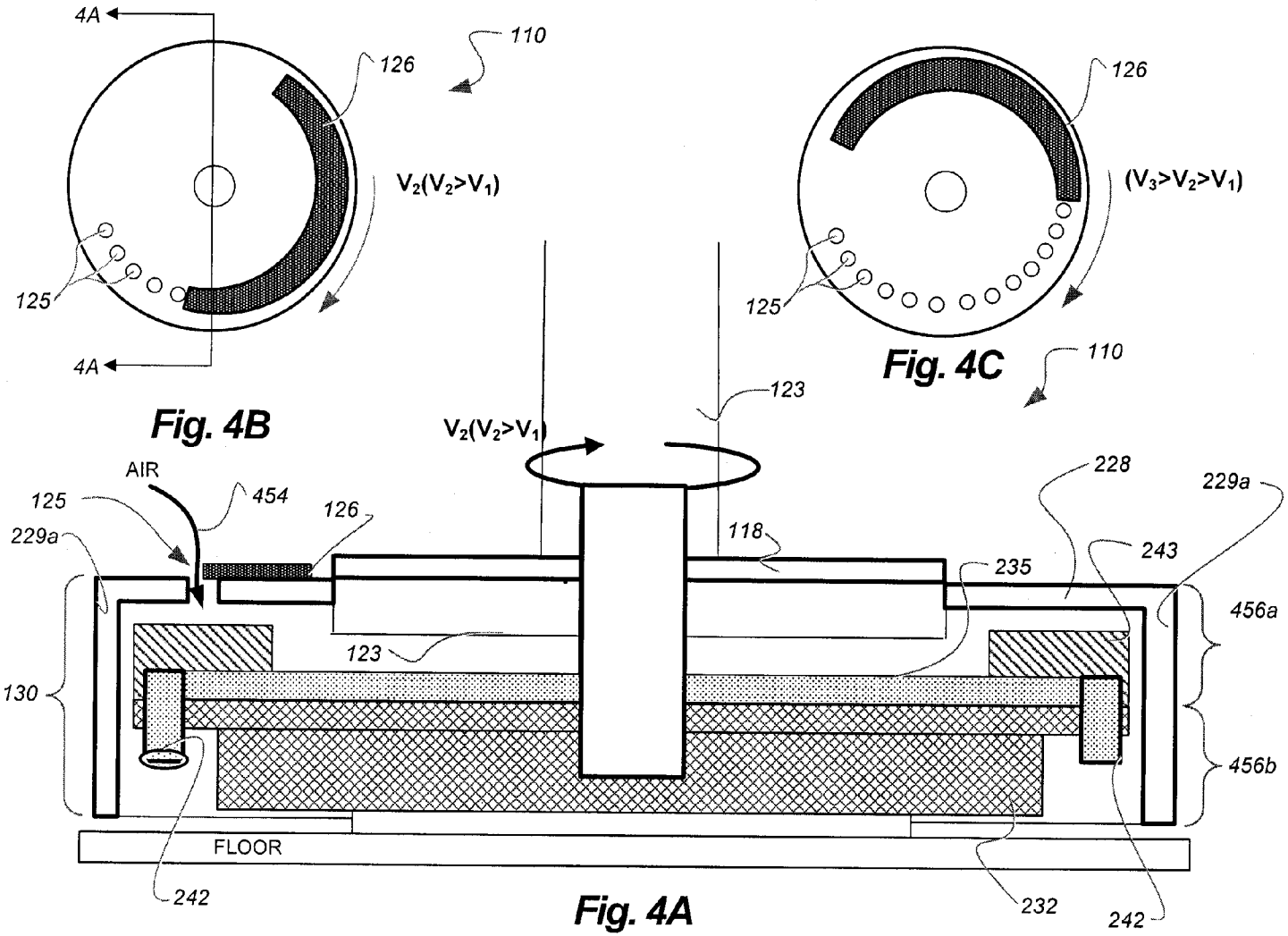
FIGS. 4A and 4B are a side view illustration (FIG. 4A) and a top view illustration (FIG. 4B) of the cleaning head of FIG. 1 in a second operational state in accordance with an embodiment of the present technology.
FIG. 4C a top view illustration of the cleaning head of FIG. 1 in a third operational state in accordance with an embodiment of the present technology.

FIGS. 4A and 4B are, respectively, cross-sectional and top view illustrations of the cleaning head 110 in a second state of operation in which the spray assembly 130 has a second rotational speed $V_2$ greater than the first rotational speed $V_1$. Referring to FIGS. 4A and 4B together, the louver 126 is configured to cover only some of the flow-control inlets 125. When the louver 126 is opened, the vacuum inlet 123 draws ambient air (shown as air flow 454) into the housing 118 through the flow-control inlets 125 and across the second side 235 of the plate 232. It is believed that the rapidly moving air flow 454 across the fins 243 creates lift. It is also believed that this lift in turn increases the rotational speed of the spray assembly 130 (i.e., relative to the first rotational speed $V_1$).

In some embodiments, the plate 232 can separate an upper region 456*a* within the enclosure of the housing 118 from a lower region 456*b*. In the upper region 456*a*, the rotating fins 243 create turbulent air flow. In the lower region 456*b*, the plate 232 is configured to prevent or at least restrict air from mixing with spent fluid (i.e., due to the small gap between the plate 232 and the first sidewall 229*a*).

FIG. 4C is top view illustration of the cleaning head 110 in a third state of operation in which the spray assembly 130 has a third rotational speed $V_2$ greater than the first and second rotational speeds $V_1$, $V_2$. The louver 126 is positioned to fully open all the flow-control inlets 125 to the ambient air. Relative to FIGS. 4A-4B, the completely uncovered inlets 125 allow a larger amount of airflow to enter the cleaning head 110. The larger amount of airflow is believed to create additional lift which further increases the rotational speed of the spray assembly 130.

One feature of several embodiments of the technology disclosed herein is that the louver 126 can be operated to control the rotational speed of the spray assembly. For example, an operator can adjust the louver (e.g., by opening or closing the louver) to achieve a rotational speed that yields a suitable cleaning efficacy. An advantage of this feature is that the operator can make a small or large refinement if the fluid-supply pressure drops, the chemistry become diluted, and/or a rough or heavily soiled surface is encountered. This can save time the operator time that might ordinarily be required to adjust fluid pressure, change chemistry, etc.

Another feature of several embodiments of the technology disclosed herein is that the cleaning head 110 can be operated at lower pressures. For example, in some instances delicate surfaces, such as wood decking, can require lower fluid pressures than are used for more robust surfaces. However, lowering the pressure also lowers the rotational speed. Typically, lower rotational speeds are less effective at cleaning and have a higher rate of smearing. In conventional systems, larger rotational speeds at lower pressures would require a motor to provide assistance to the rotation. Thus, an advantage of the cleaning head 110 is that the operator can operate at certain rotational speeds independent of the fluid pressure. For example, if a surface can only be cleaned with a low pressure fluid, the operator can open the louver 126 to provide suitable rotation speed for appropriate cleaning efficacy.

A further advantage of at least some of the foregoing embodiments is that the spray assembly 130 can mitigate the effect of turbulent air flow within the enclosure of the cleaning head 110. For example, the plate 232 can separate air flow through the flow-control inlets 125 to the vacuum inlet 103 the upper and lower regions 456*a*, 456*b* of the spray assembly from each other and thus isolate the effects of turbulence (which may result from air flow through the flow-control inlets 125 to the vacuum inlet 103 from the cleaning action at the floor surface 104.

Figure 5B:
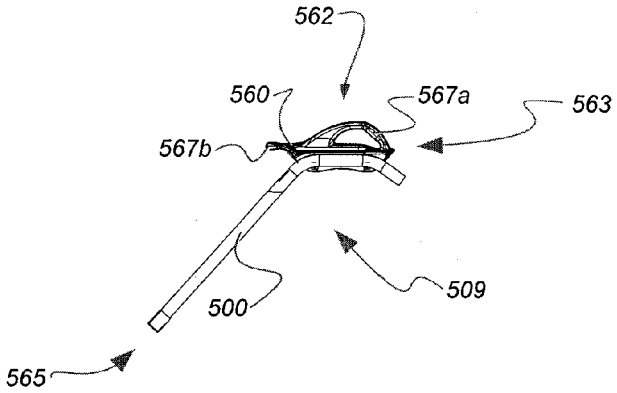
FIGS. 5A-5B are isometric illustrations of another surface cleaner configured in accordance with an embodiment of the present technology.
Figure 5A:
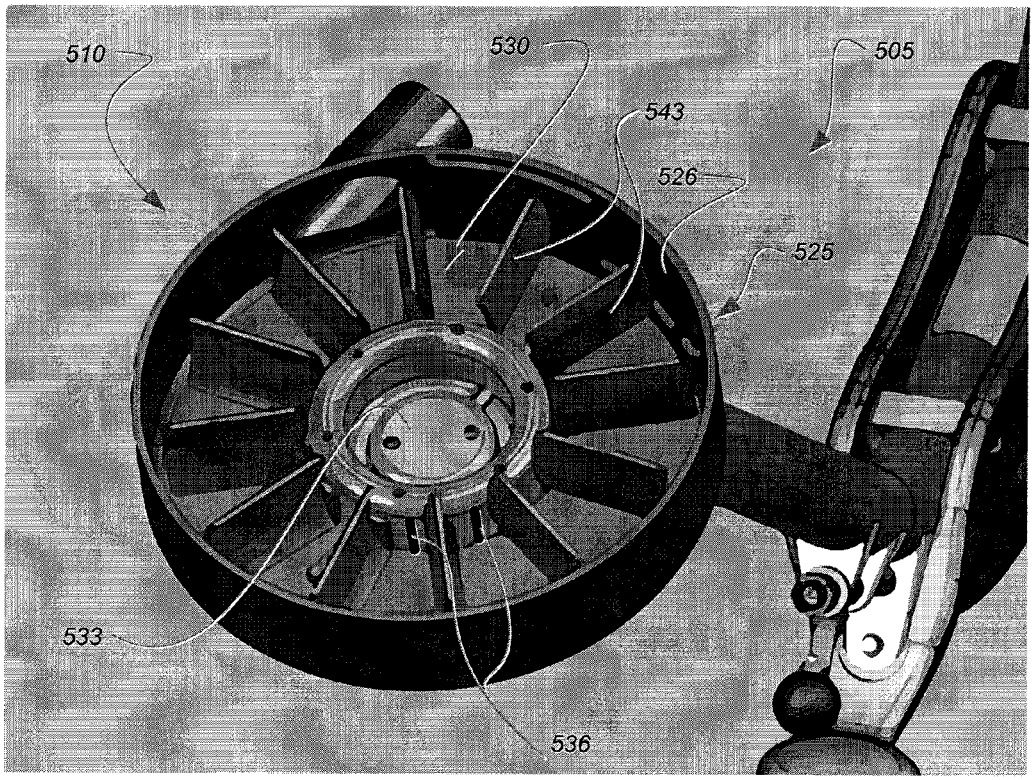

FIGS. 5A-5B are isometric illustrations of a surface cleaner 505 configured in accordance with another embodiment of the present technology. Referring to 5A, the surface cleaner 505 can include a cleaning head 510 that operates in much the same way as the cleaning head 110. However, the cleaning head 510 includes a side-mounted louver 526 and a single fluid control inlet 525. Also, the cleaning head 510 includes a rotatable spray assembly 530 having a shaft 533 carrying a hub with slots 536. The slots 536 can support removable fins 543. In this embodiment, the removable fins 543 can be exchanged with different fins (e.g., fins that are differently sized, shaped, angled, etc.). Also, the slots 536 allow for a varying number of fins. Accordingly, in this embodiment, the fins 533 can be adapted to achieve an expected lift and/or rotational speed.

Referring to 5B, the surface cleaner 505 can include a transport assembly 509 having a different configuration than the transport assembly 109 (FIG. 1). For example, the transport assembly 509 can have a "wand" configuration that includes a tubular member 560 with a handle 562 operably coupled to a first end portion 563 and the cleaning head 510 (not shown in FIG. 5B) operably coupled to a second end portion 565. In this configuration, an operator can hold the surface cleaner 505 by grasping grip regions of the handle 562. For example, the operator can carry the weight of the surface cleaner using a first grip region 567*a* and orient (e.g., angle) the cleaning head 510 using the second grip region 567*b*.

Figure 6A:
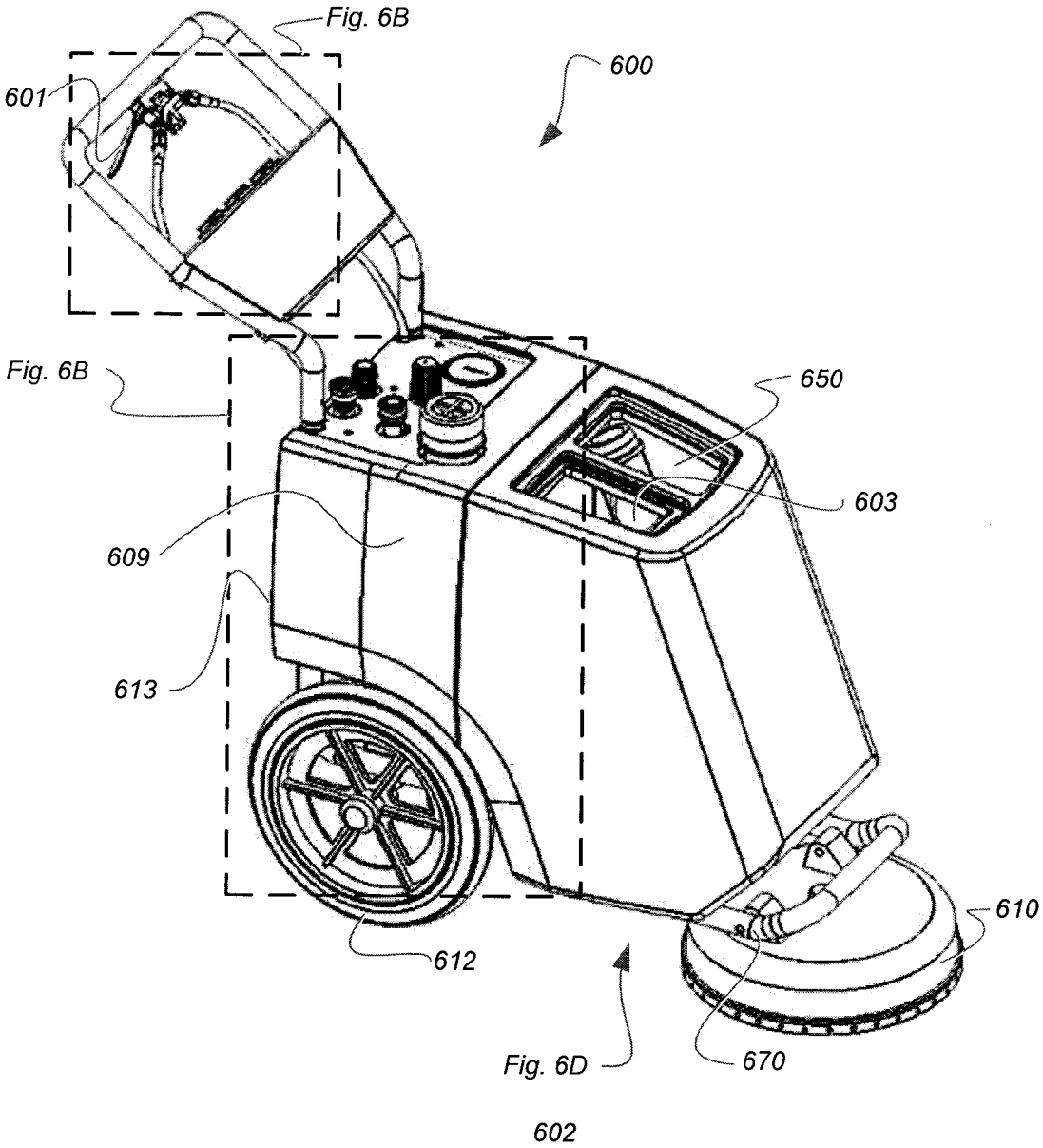
FIGS. 6A-6D are isometric illustrations (FIGS. 6A and 6B), a front view illustration (FIG. 6C), and a bottom view illustration (FIG. 6D) of a self-contained, hard-surface cleaning system configured in accordance with an embodiment of the present technology.

FIGS. 6A-6D are isometric illustrations (FIGS. 6A and 6B), a front view illustration (FIG. 6C), and a bottom view illustration (FIG. 6D) of a self-contained, hard-surface cleaning system 600 configured in accordance with an embodiment of the present technology. Referring first to FIG. 6A, the self-contained cleaning system 600 can include a transport assembly 609 (e.g., a chassis or other support platform) that is movable over a floor surface via one or more wheels 612. The transport assembly 609 can carry a cleaning head 610 that cleans a floor surface over which the system 100 traverses. In one embodiment, the cleaning head 610 is similar in structure and operation to one of aforementioned cleaning heads 110, 510. In another embodiment, the cleaning head 610 can include different aspects. For example, a level bar 670 can be attached to the transport assembly 609 for positioning the cleaning head 110 generally in parallel with a floor surface.

The transport assembly 609 also carries a water supply fixture 603. The water supply fixture 603 is coupled to a first pump 630*a* show in FIG. 6B. The water supply fixture 603 can be connected to a water supply hose (not shown) via a first fluid inlet 621. For example, the water supply hose can be coupled to an indoor or outdoor water faucet. The water supply fixture 603 directs the incoming fresh water to the first pump 630*a*, which pressurizes the water prior to delivering the water to the cleaning head 610. In a particular embodiment, the first pump 630*a* pressurizes the water to approximately 1200 psi and in other embodiments, the first pump 630*a* pressurizes the water to other suitable pressures. The force of the water exiting the spray nozzles (not visible) can rotate a spray bar (also not visible) at a rate of from about 1500 to about 2000 rpm.

Figure 6B:
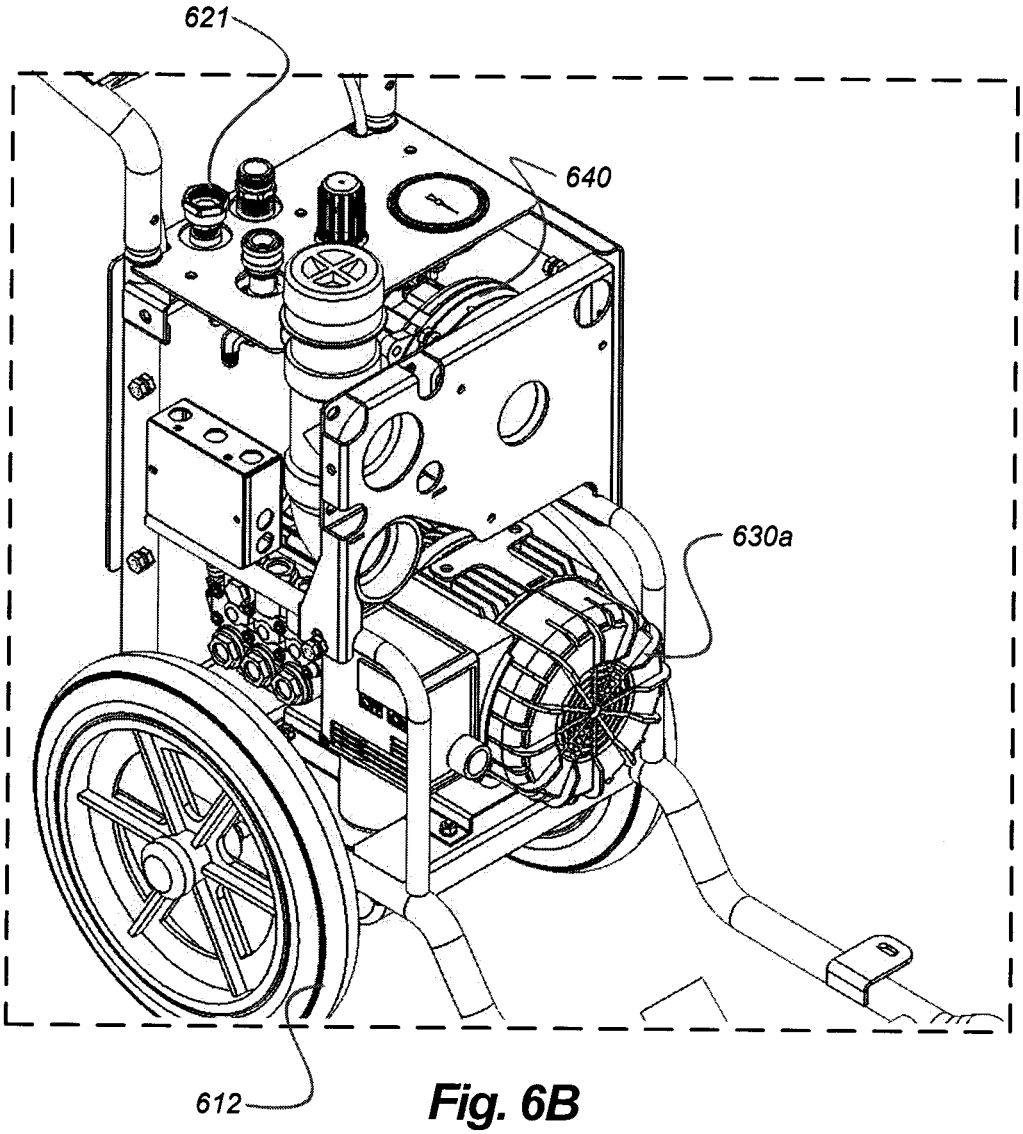
Figure 6C:
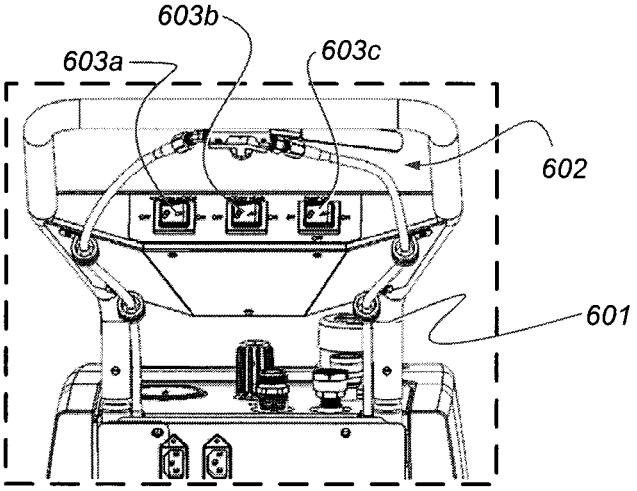
Figure 6D:
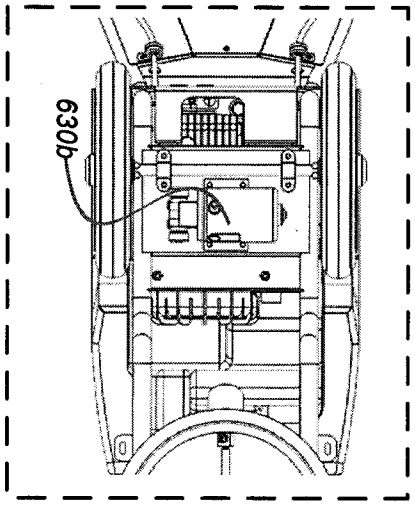

The system 100 can further include a vacuum source 640 (e.g., a vacuum pump) also shown in FIG. 6B carried by the transport assembly 609 and coupled to the cleaning head 610 with a vacuum hose (not shown; e.g., a relatively short vacuum hose). The vacuum source 640 can be an electrically powered vacuum source, which receives electrical power via a power cable. The vacuum source 640 draws a vacuum on the cleaning head 610 via the vacuum hose, and directs exhaust outwardly via a vacuum exhaust (not shown). As wastewater, debris and air are removed by the vacuum source 640 from the cleaning head 610, the water and other debris may be collected in a vessel or tank 650 (FIG. 6A), also carried by the transport assembly 609. As the vessel 650 fills with water and/or debris, the user can periodically or continuously empty the vessel using a pump-out hose not shown that is coupled to a second pump 630*b* (FIG. 6D). Accordingly, the user can clean the target surface and direct the collected wastewater to a suitable drain or other facility.

Referring again to FIG. 6A, the transport assembly 609 can further include a handle 601 for pushing and/or pulling the transport assembly 609. Now referring to FIG. 6C, the handle 601 can further includes one or more sets of controls 602 for directing the flow of fresh water into the cleaning head 610, directing the operation of the vacuum source 640, and/or directing the process of emptying the vessel 650. In a particular embodiment, the controls 602 include a first switch 603*a*, to initiate water flow, a second switch 603*b* that powers the vacuum source 640, and a third switch 603*c* that powers the second pump 630*b*.

In several embodiments, one advantage of the self-contained system disclosed herein is that multiple components used for cleaning hard surfaces can be carried by a single chassis. For example, a single chassis can carry the cleaning head, the wastewater collection vessel, the vacuum source, a pump for delivering high pressure water, and a pump for emptying the collection vessel. An advantage of this feature is that it can reduce overall system complexity by providing all the necessary components in one compact platform. In other embodiments, one or more of these components may be moved off the chassis while still providing at least some of the advantages described above.

In at least some of the foregoing embodiments, another advantage of the self-contained system is that the water supply hose can be coupled to a conventional faucet, and can be pressurized using an on-board first pump 630*a*. An advantage of this arrangement is that it can eliminate the need for larger truck-mounted or separate portable pressurized water systems. In addition, the self-contained cleaning system 600 can include an on-board vacuum source 640 and provisions for emptying the vessel 650 into a conventional drain (e.g., the second pump 630*b* and a pump-out hose). Advantages of these features include an overall compact arrangement, and a system that can be particularly suitable for the homeowner, occasional user (e.g., renter), and/or a user without access to more complex truck-mount systems.

In at least some of the foregoing embodiments, a further advantage of the self-contained system is that a vacuum hose between the vacuum source 640 and the cleaning head 610 is relatively short because the vacuum source 640 and the cleaning head 610 are within the common transport assembly 609. By eliminating the long hoses typically connecting conventional cleaning heads to truck-mounted or portable collection systems, the overall system efficiency can be improved by reducing frictional losses.

From the foregoing, it will be appreciated that specific embodiments have been described herein for purposes of illustration, but that various modifications may be made without deviating from the disclosed technology. For example, in at least some embodiments, the cleaning head has nozzles that are configured to receive fluid from a spray bar; however, in other embodiments, different components such as flexible tubing can deliver the fluid. In other embodiments, a cleaning head as described herein can be configured so that fluid-supply inlet, vacuum supply inlet, and/or the flow-control inlet are arranged differently. For example, a vacuum supply inlet can be arranged toward a sidewall of the housing (rather than a top wall; see, e.g., FIG. 5A).

The methods disclosed herein include and encompass, in addition to methods of making and using the disclosed devices and systems, methods of instructing others to make and use the disclosed devices and systems. In some embodiments, such instructions may be used to teach the user how to operate a cleaning system, a hard surface cleaner, and/or a cleaning head. For example, the operating instructions can instruct the user how to provide any of the operational aspects of FIGS. 3A-6B, such as controlling the velocity of the round plate 232. In other embodiment, the operating instructions can instruct the user how to operate various aspects of the self-contained cleaning system 500, such as the pumps 630 and/or the vacuum source. In some embodiments, methods of instructing such use and manufacture may take the form of computer-readable-medium-based executable programs or processes.

Moreover, aspects described in the context of particular embodiments may be combined or eliminated in other embodiments. Further, although advantages associated with certain embodiments have been described in the context of those embodiments, other embodiments may also exhibit such advantages, and not all embodiments need necessarily exhibit such advantages to fall within the scope of the presently disclosed technology.

We claim:

1. A cleaning head, comprising:

a housing having a fluid-supply inlet, a vacuum inlet, and at least one flow-control inlet, wherein the vacuum inlet is positioned to draw a flow of air through the flow-control inlet;

a spray assembly at least partially enclosed within the housing, wherein the spray assembly includes a shaft, at least one spray nozzle operably coupled to the shaft, and a plurality of fins also operably coupled to the shaft, wherein:

the shaft includes a passageway in fluid communication with the fluid supply inlet;

the spray nozzle is arranged to receive a pressurized fluid from the fluid-supply inlet;

the spray nozzle is positioned and oriented downwardly to rotate with the shaft; and the fins are positioned at least partially within the flow of air through the flow-control inlet;

a spray bar fluidly coupling the passageway of the shaft with the nozzle; and a round plate rotatably coupled to the shaft and configured to carry the spray bar, the nozzle, and the fins, wherein:

the plate includes an outer surface and an inner surface at least partially surrounded by the outer surface; and the inner surface is positioned below the outer surface.

2. The cleaning head of claim 1, further comprising a louver operably coupled to the housing and configured to adjustably cover the flow-control inlet to control the flow of air flow through the flow-control inlet.

3. The cleaning head of claim 1 wherein the flow control inlet comprises a plurality of openings extending through a wall of the housing, wherein the louver is configured to adjustably cover the openings.

4. The cleaning head of claim 1 wherein the flow control inlet comprises a single opening extending through a sidewall of the housing, wherein the louver is configured to adjustably cover the opening.

5. The cleaning head of claim 1 wherein the housing at least partially defines an enclosure, and wherein the plate is configured to separate an upper region of the enclosure from a lower region of the enclosure to control turbulance within the enclosure.

6. The cleaning head of claim 1 wherein:

the nozzle is disposed toward a periphery of the plate, and the plate includes a notch through which the nozzle extends downwardly.

7. The cleaning head of claim 1 wherein each of the fins projects beyond the outer surface of the plate.

8. The cleaning head of claim 1 wherein each of the fins extends between the inner and outer surfaces of the plate.

9. A surface cleaning system, comprising:

a transport assembly;

a cleaning head operably coupled to the transport assembly, wherein the cleaning head at least partially defines an enclosure, and wherein the cleaning head includes:

a housing at least partially defining an enclosure, wherein the housing includes:

a wall;

a fluid-supply inlet positioned to deliver a fluid to the enclosure;

a vacuum inlet positioned to draw a vacuum on the enclosure;

a flow-control inlet positioned related to the vacuum inlet to draw ambient air into the enclosure and toward the vacuum inlet; and a spray assembly disposed in the housing, wherein the spray assembly includes:

a rotatable plate having an outer surface and an inner surface at least partially surrounded by the outer surface, wherein the inner surface is positioned below the outer surface;

a spray bar operably coupled to the plate and positioned to receive fluid from the fluid-supply inlet, wherein the spray bar includes individual spray nozzles disposed at opposing ends of the spray bar configured to deliver the fluid; and a plurality of fins operably coupled to the plate and positioned to be at least partially within the flow of the ambient air drawn into the enclosure.

10. The system of claim 9 wherein the transport assembly comprises a columnar frame and a hinge operably coupling the frame with the cleaning head.

11. The system of claim 9 wherein the transport assembly comprises a wand having a handle and a tubular member operably coupling the handle with the cleaning head.

12. The system of claim 9 wherein the transport assembly comprises a wheeled chassis, and wherein the system further comprises:

a fluid supply fixture carried by the chassis and fluidly coupled to the fluid-supply inlet;

a first pump carried by the chassis and coupled to the spray bar to pressurize the fluid delivered to the nozzles;

a vacuum source carried by the chassis and coupled to the cleaning head to remove spent fluid from the enclosure;

a vessel carried by the chassis and coupled to the cleaning head to contain the spent fluid removed by the vacuum source; and a second pump carried by the chassis and coupled to the vessel to remove the spent fluid from the vessel.

13. The system of claim 9 wherein the rotatable plate has a generally round shape.

14. The system of claim 9 wherein the spray bar is between a portion of the wall of the housing and the outer surface of the plate.

15. The system of claim 9 wherein the flow control inlet comprises one or more openings extending through a portion of the wall, and wherein the louver is configured to adjustably cover the one or more openings.

16. A surface cleaning system, comprising:

a housing having a fluid-supply inlet, a vacuum inlet, and at least one flow-control inlet, wherein the vacuum inlet is positioned to draw a flow of air through the flow-control inlet; and a spray assembly at least partially enclosed within the housing, wherein the spray assembly includes:

a shaft, at least one spray nozzle arranged to receive a pressurized fluid from the fluid-supply inlet, a plurality of fins operably positioned at least partially within the flow of air through the flow-control inlet, and a rotatable plate operably coupling the at least one spray nozzle and the plurality of fins to the shaft, wherein the rotatable plate includes an inner surface that is positioned to:

face a floor surface and be separated therefrom by a gap; and impart momentum to spent fluid in the gap for removal via rotation of the plate in combination with surface tension at the inner surface.

17. The cleaning system of claim 16 wherein the rotatable plate further includes an outer surface facing away from and surrounding the inner surface.

18. The cleaning system of claim 16, further comprising a fluid supply fixture configured to containing a cleaning fluid;

a pump configured to pressurize the cleaning fluid and to deliver the pressurized fluid to the at least one spray nozzle;

a chassis carrying the fluid supply fixture, the pump, the housing, and the spray assembly.

19. The system of claim 18, further comprising a vacuum source carried by the chassis and coupled to the vacuum inlet to remove the spent fluid from the gap.

* * * * *